United States Patent [19]

Terminella et al.

[11] Patent Number: 5,014,489

[45] Date of Patent: May 14, 1991

[54] FILM SHEET FEED FOR FOOD TRAY FILM WRAPPING MACHINE

[75] Inventors: Frank Terminella; Emanuele Terminella, both of Fayetteville; William Stroud, Farmington; Joseph E. Terminella, Fayetteville, all of Ark.

[73] Assignee: Pacmac, Inc., Fayetteville, Ark.

[21] Appl. No.: 467,873

[22] Filed: Jan. 19, 1990

Related U.S. Application Data

[63] Continuation-in-part of Ser. No. 404,215, Sep. 7, 1989.

[51] Int. Cl.[5] ..... B65B 11/18; B65B 57/08; B65B 57/16

[52] U.S. Cl. ..... 53/51; 53/58; 53/67; 53/228; 53/556; 53/389

[58] Field of Search ..... 53/58, 72, 51, 67, 228, 53/222, 556, 389

[56] References Cited

U.S. PATENT DOCUMENTS

| | | | |
|---|---|---|---|
| 2,127,028 | 8/1938 | Hayssen | 53/51 |
| 2,130,775 | 9/1938 | Neumair | 53/51 |
| 2,730,359 | 1/1956 | Smith | 53/51 |
| 4,178,740 | 12/1979 | Groom | 53/556 |
| 4,543,766 | 10/1985 | Boshinski | 53/556 X |
| 4,631,903 | 12/1986 | Takamura | 53/228 X |
| 4,730,441 | 3/1988 | Terminella | 53/556 |

*Primary Examiner*—John Sipos
*Attorney, Agent, or Firm*—Robert R. Keegan

[57] ABSTRACT

There is disclosed a food tray film wrapping machine having an improved film feeding mechanism particularly adapted to feeding pre-printed film from a continuous roll and assuring proper registration of the printing on the film-wrapped tray, including a receiving position for a large film roll provided with a pair of rollers for cradling the film roll, a film feed motor separate from the main wrapping machine motor, an automatic motor control responsive to optical sensors for sensing an index mark on the film sheet and for sensing the presence of a food tray at the machine wrapping station to stop and start the film feed motor, a perforating knife positioned adjacent the index mark sensor for perforating the film on a line across the film without separating it, and an arrangement of a filmfolding arm with gripping means for the film whereby the film sheet is separated at the perforation line as the folding arm tucks the trailing edge of the film sheet at the wrapping station under the food tray. The film feed mechanism also includes means for accommodating different spacing between printed patterns including a movable roller between the index mark sensor and the wrapping station which is operable to adjust the path length of the film between those two points allowing the pattern on the film to be registered in the desired position on the trays.

12 Claims, 5 Drawing Sheets

FILM SHEET FEED FOR FOOD TRAY FILM WRAPPING MACHINE

This application is a continuation-in-part of application Ser. No. 404,215 for "Compact Food Tray Film Wrapping Machine" filed Sept. 7, 1989.

The present invention relates to tray package wrapper machines which are commonly used to wrap trays of meat, particularly poultry, with stretchable polyvinyl chloride or similar wrapping material so that the food product is visible to the purchaser while at the same time being maintained in a sanitary condition. Usually the PVC film or other wrapping material is pre-printed with decorative designs and/or trademarks to make the finished package more attractive to the consumer.

To achieve economy and efficiency, tray package wrapping machines of this type are partially or fully automated. Generally uncovered trays containing food products are fed into the machine (by hand or otherwise) and the machine transports the tray to a platform where it is elevated and enfolded on the top and sides with stretchable film sheet supplied from a storage roll in the machine. Thereafter the edges of the film sheet are folded under the tray from the two sides and from the two ends to provide a food tray provided with a sanitary covering of film wrap imprinted with a decorative design and trademark. The clinging nature of the film prevents the edges from coming loose at the bottom of the tray as it is transported out of the wrapping machine, and the tray bottom is commonly heated and pressed to further secure the film in place. A machine of the type described above is shown and explained in U.S. Pat. No. 4,730,441 to Terminella et al. granted Mar. 15, 1988 (U.S. Cl. 53/556).

According to the present invention a tray film wrapping machine includes means for holding and unwrapping a large roll of wrapping film under automatic control and causing the film to be fed to the wrapping station and positioned properly with respect to the pattern imprinted thereon so that the finished wrapped tray has the trademark, design, or other imprinting properly registered with respect to the tray. The film sheet feeding apparatus also includes an automatic perforating knife which causes the film sheet to be perforated between the printed patterns with the perforation appropriately placed to be separated later by the action of one of the folding arms.

Preferably the advance of the film sheet is effectuated by a separate film feed motor independent of the main motor driving the operating cams of the machine and the film feed motor is automatically controlled to feed film in response to optical sensing of a tray in position to be wrapped.

Also according to the invention, the machine is adjustable to allow for different sizes of film wrap sheet as required on different size trays and this is accomplished preferably by changing the path length of the film between the index mark sensing apparatus and the wrapping station. The automatic motor control also provides means for advancing predetermined lengths of film rather than responding to the sensing of index marks on the film, thereby allowing film without index marks to be used in the machine.

Fail safe features are provided so that the film will not be advanced in the absence of a tray in position to be wrapped, and other such features prevent malfunction of the apparatus which would interrupt the production of wrapped trays.

In previous film wrapping machines means were often provided to maintain registration of printed patterns on the trays, but a common arrangement was to advance the sheet by a predetermined distance with normal operation of the machine and provide another feature for automatically making small adjustments in the film position to correct registration errors. The machine according to the present invention provides more effective trouble free operation by an independent film transport mechanism that may be controlled solely by the index mark sensing and wherein different lengths of sheet feed are accommodated by changing the film path length between the index mark sensor and the wrapping station. At the same time the machine according to the present invention provides very good accessability for loading a roll of wrapping film and for threading the leading edge of the new wrapping film into the front of the film transport mechanism.

In addition to providing the features and advantages described above it is an object of the present invention to provide a food tray film wrapping machine where the film feed apparatus is arranged to give easy access for loading and threading the rolls of wrapping film.

It is another object of the present invention to provide a food tray film wrapping machine having a film feed motor independently controlled in response to sensing of registration marks on the film received from a substantially fixed optical sensor.

It is yet another object of the present invention to provide food tray film wrapping machine wherein the film is positioned in response to registration marks on the film to cause perforations made by a perforating knife to be properly located between patterns on the film.

It is a still further object of the present invention to provide a food tray film wrapping machine wherein the action of a film wrapping arm at the wrapping station is effective to separate a sheet of film from the continuous roll at a previously created perforation line.

It is a still further object of the present invention to provide a food tray film wrapping machine wherein the proper registration of printed film sheets on the tray packages is achieved by adjustment of the path length of the film between a mark sensor position and the tray wrapping station.

Other objects and advantages of the invention will be apparent from consideration of the following description in conjunction with the appended drawings in which.

Figure 1:
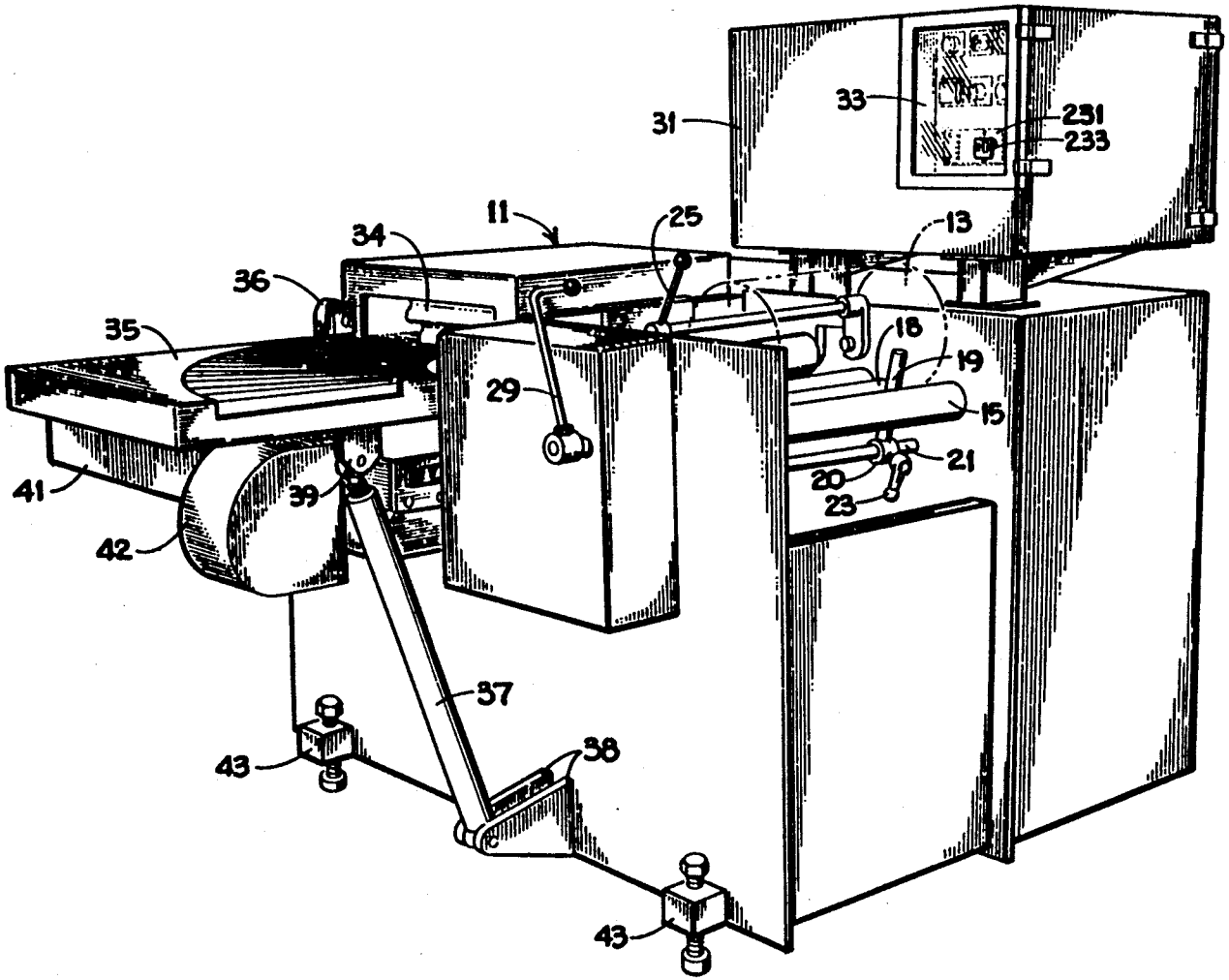
FIG. 1 is a perspective view of a tray package wrapper machine incorporating features according to the present invention.

Referring now to the drawings and particularly to FIG. 1, a food tray film wrapping machine 11 is shown incorporating features of the present invention. A conventional roll 13 of PVC film wrap may be loaded into the machine 11 in a convenient manner as indicated in phantom lines; the roll 13 of film rests on rollers 15 and 18 and a continuous film sheet 3 feeds from the top of roll 13 around roll 18 into the wrapping machine 11, as better seen in FIG. 2.

To allow for various widths of PVC film on roll 13 a locator bar 19 extends upwardly between rollers 15 and 18 and is slidably mounted on a rod 21 by means of a collar 20. Thus locator bar 19 may be moved to lightly contact the end of roll 13 and locked in place by clamp 23 thereby to prevent unwanted lateral displacement of roll 13. Additional guides for lateral positioning of the film from roll 13 may be provided if desired. Mounted atop the film wrapping machine 11 is a control unit 31 containing electronic controls and apparatus and having a door 33 behind which are various conventional indicators and operator accessible controls for the wrapping machine 11. Preferably door 33 is provided with a transparent front panel so that the controls and indicators are visible without opening door 33.

Shown at 233 is a decade or thumbwheel switch 233 used by the operator to set &he film sheet feed to automatic or to feed a desired length of film at each machine cycle, as will later be explained in detail. As more fully explained in the above mentioned patent or application, a hold down belt 34 restrains the trays as they exit from machine 11 onto curved roller conveyor 35. Conveyor 35 is rotatable about hinge 36 so that it may be tipped upward to give access to the lower portion of the machine through which the trays and film sheet are input to the machine. A strut 37 may include an air cylinder connected by brackets 38 and 39 and serves to hold conveyor 35 in an upwardly tilted position This arrangement and the input conveyor for the apparatus form no part of the present invention and are not shown in detail, the input apparatus being concealed by covers 41 and 42. Levelling devices 43 of conventional form are provided to facilitate positioning machine 11 in a level and stable position.

Figure 2:
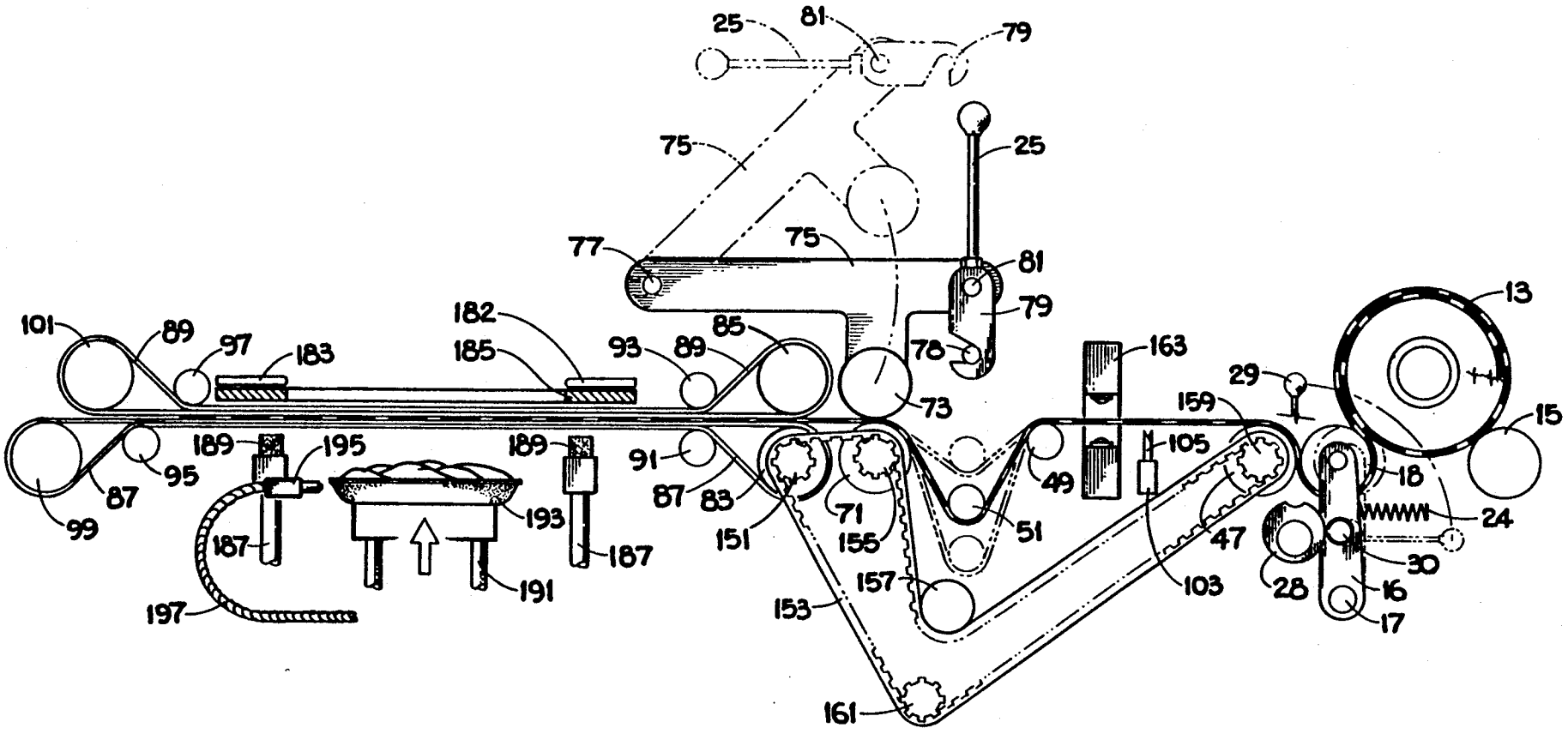
FIG. 2 is an elevational partially sectional, partially schematic view of the film feed apparatus of the machine of FIG. 1.
Figure 3:
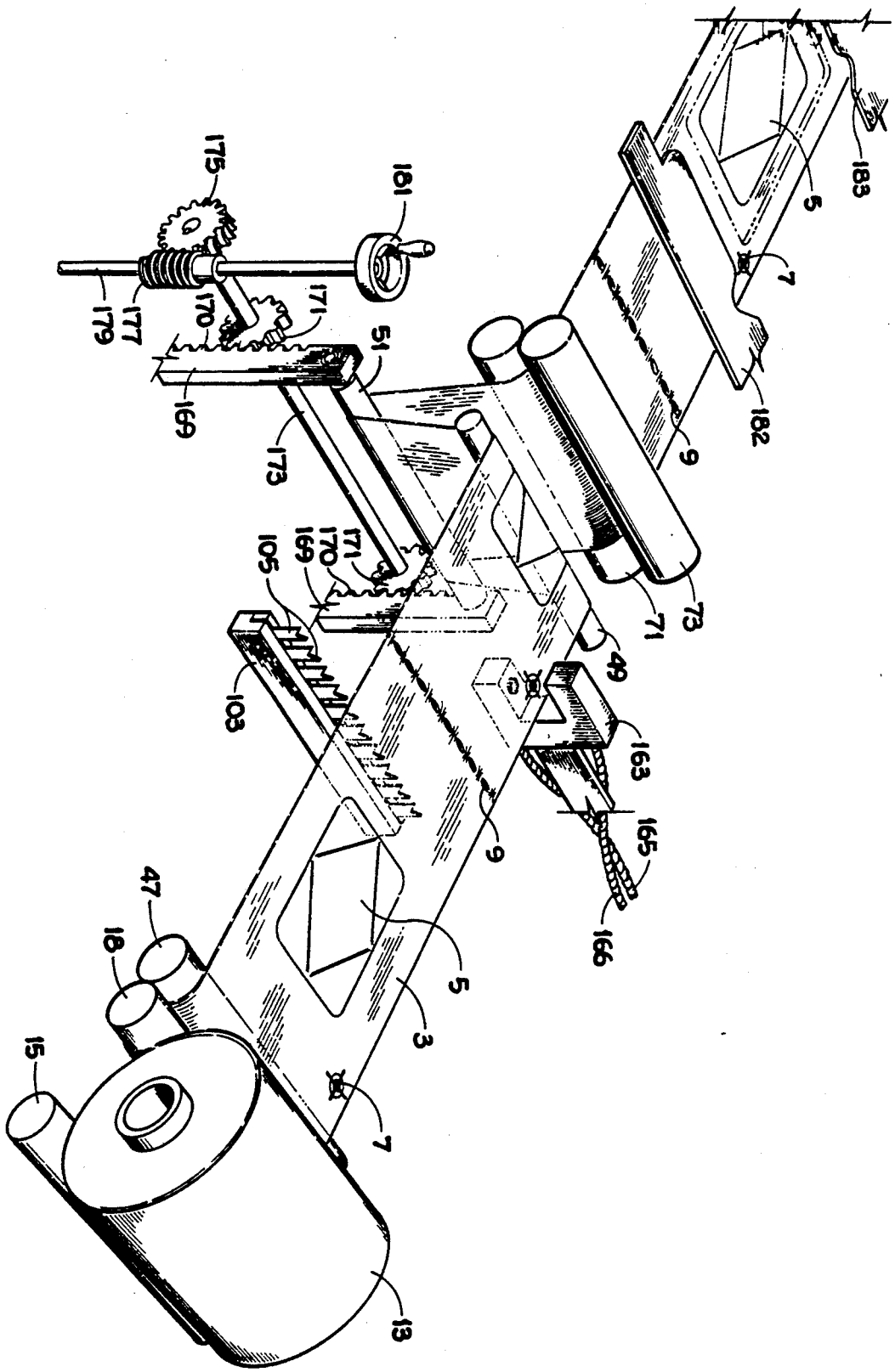
FIG. 3 is a schematic view showing the film feed path adjustment means for different sizes of trays and film wrap sheets.
Figure 4:
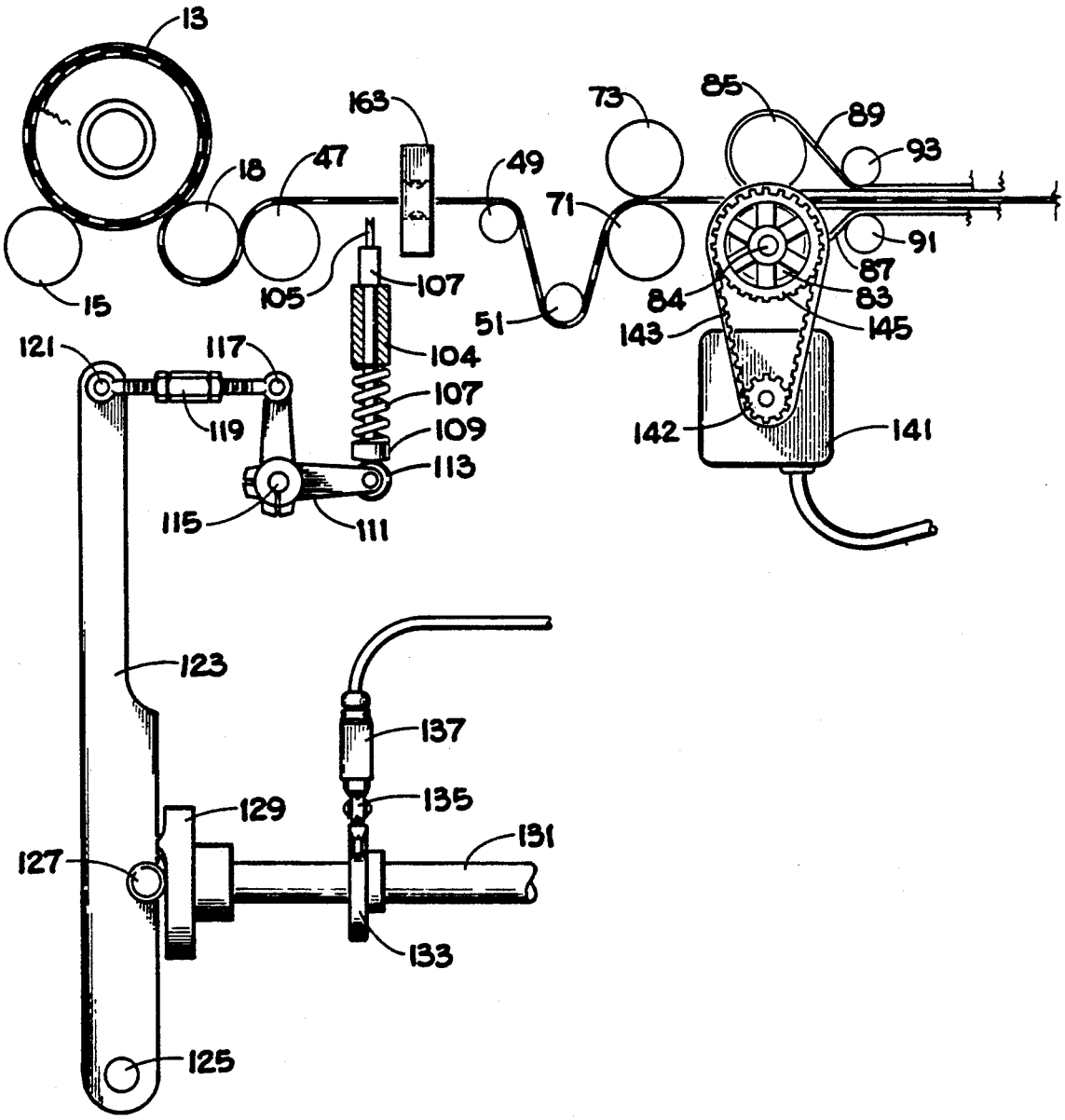
FIG. 4 is a rear elevational detail view in partially schematic form of the actuating apparatus for the perforating knife shown in FIGS. 2 and 3.

The structure and operation of the film feed apparatus of machine 11 is best seen by reference to FIGS. 2, 3 and 4. It will be noted that FIG. 2 is a front view, FIG. 3 is a perspective view, and FIG. 4 is a rear view. In FIGS. 2 and 3 it will be seen that the PVC film sheet 3 feeds off roll 13 in a counter-clockwise direction, passing clockwise around roll 18 and between roll 18 and a roll 47. It is an important feature of the present apparatus to locate and arrange the film feed apparatus to provide maximum ease and simplicity in loading a new roll 13 of PVC film wrap into the machine This reduces to a minimum the amount of down time during unavoidable shut downs for replacement of the PVC film roll and also substantially eliminates down time due to malfunctions resulting from improper loading and threading of the film sheet.

To facilitate threading the film sheet 3, roller 18 is rotatably mounted on arm 16 which is in turn pivotally mounted on a shaft 17; a spring 24 urges arm 16 in a direction to cause roller 18 to press against roller 47, but roller 18 may also be moved to the right in FIG. 2 to allow film sheet 3 to be easily threaded between roller 18 and 47. The loading operation is facilitated by operation of a lever 29 to cause rotation of a cam 28, which is in contact with a cam follower 30 mounted on arm 16. The path for film sheet 3 continues to the left as shown in FIG. 2 where it passes over a roller 49 then under a vertically movable roller 51 and over another roller 71.

Roller 73 cooperates with roller 71 to grip and transport the wrapping film 3; roller 73 is rotatably affixed to arms 75 which are pivotally mounted in the machine by pins 77 or the like. Thus roller 73 can be raised to thread the film into the machine, and its raised position is shown in phantom lines in FIG. 2.

A hook latch 79 is provided to maintain roller 73 in the lower position and provide the proper pressure of roller 73 on roller 71. Hook latch 79 is rotatably secured on arm 75 with a shaft 81 and is provided with a handle 25 to facilitate releasing the latch from engagement with a pin 78; a second latch similar to latch 79 may be provided for the other end of roller 73.

The wrapping mechanism itself as shown in FIG. 2 may be generally similar to that shown in previously mentioned U.S. Pat. No. 4,730,441 or application Ser. No. 404,215. After passing through rollers 71 and 73, film sheet 3 is gripped, at its edges only, by belts 87 and 89 which serve to transport it to a position over tray 193 on elevator 191. In a generally conventional manner rollers 83, 85, 91, 93, 95, 97, 99 and 101 maintain the moving belts 87, 89 in the proper path and in contact with one another. Belts 87 and 89 may move only slightly faster than rollers 71 and 47.

As best seen in FIG. 4, roller 83 is mounted on a shaft 84 along with a cog wheel 145 which is coupled for rotation with it. Cog wheel 145 and roller 83 are driven through toothed belt 143 by a smaller cog wheel 142 on the output shaft of film feed motor 141. Although the manner in which the other rollers are driven from roller 83 is subject to variation, a suitable arrangement shown in FIG. 2 includes a cog wheel 151 and a toothed belt 153 driving a cog wheel 155 connected to roller 71 and a cog wheel 159 connected to roller 47. Idlers 157 and 161 maintain the proper position and tension for belt 153.

Roller 73 is rotated by the rotation of roller 71 and roller 18 is rotated by contact with roller 47 a film sheet 3 passes between these roller pairs The rotation of roller 18 serves to rotate the film supply roll 13 which rests on it.

The adjustment of the position of roller 51, which serves to adjust the path length for film sheet 3 is best shown in FIG. 3. Roller 51 is mounted for rotation on a frame 169 which is vertically movable in the machine in conventional guides, not shown.

The frame 169 has rack portions 170 which are engaged by spur gears 171 mounted to turn with shaft 173. Shaft 173 is rotationally positioned by rotation of handle 181 on vertical shaft 179 which turns a worm gear 177 mounted thereon causing rotation of gear 175 engaging worm 177; shaft 173 turns with gear 175.

As seen in FIGS. 2 and 3 adjustment of the position of roller 51 causes the path length for the film sheet 3 to be varied as desired; more specifically the length of film path of sheet 3 between index mark sensors 163 and the wrapping station including folding arms 182 and 183 may be changed as desired. This provides a procedure for accommodating the different spacing between patterns 5 on film sheets 3 used in the machine as different sizes of trays are wrapped. The preferred procedure for adjusting the position of roller 51 with handle 181 is to observe the location of the pattern 5 between folding arms 182 and 183 and to register it as desired by gradual movement of roller 51 only while film 3 is feeding into the machine. In the preferred embodiment as illustrated in FIG. 2 or 3 there will be one pattern approximately centered between wrapping arms 182 and 183 and one other pattern in the path between index mark sensor 163 and folding arm 182. Of course the machine could also have two or more patterns between index mark sensor 163 and folding arm 182 and adjustability would be provided by movement of roller 51 in substantially the same manner.

A perforating knife 103 having teeth 105 is placed to be operable to make perforations 9 in sheet 3 slightly in advance of (upstream of) index mark sensor 163. The structure and operation of perforating knife 103 can best be understood by reference to FIG. 4. Knife 103 is mounted for reciprocating vertical movement in a guide bar 104 fixedly secured in the machine and is operated from the machine main drive shaft 131 which is provided with a disc type cam 129 cooperating with a cam follower 127 on knife lever 123 pivotally mounted on shaft 125. Bearing 121 on the upper end of knife lever 123 is connected by adjustable link 119 to bearing 117 on bellcrank 111 mounted on shaft 115. Roller 113 on bellcrank 111 contacts a foot 109 extending downward from knife 103 thereby causing knife 103 to reciprocate rapidly once during each cycle of the machine and main drive shaft 131. Other conventional means such as a pneumatic cylinder may be arranged to operate knife 103. This occurs at a time when film sheet 3 is stationary.

It will be noted that there is a cam 133 rotating with main shaft 131 which cyclically operates a microswitch 137 providing a signal to the film feed motor control as will later be explained in more detail.

Figure 5:
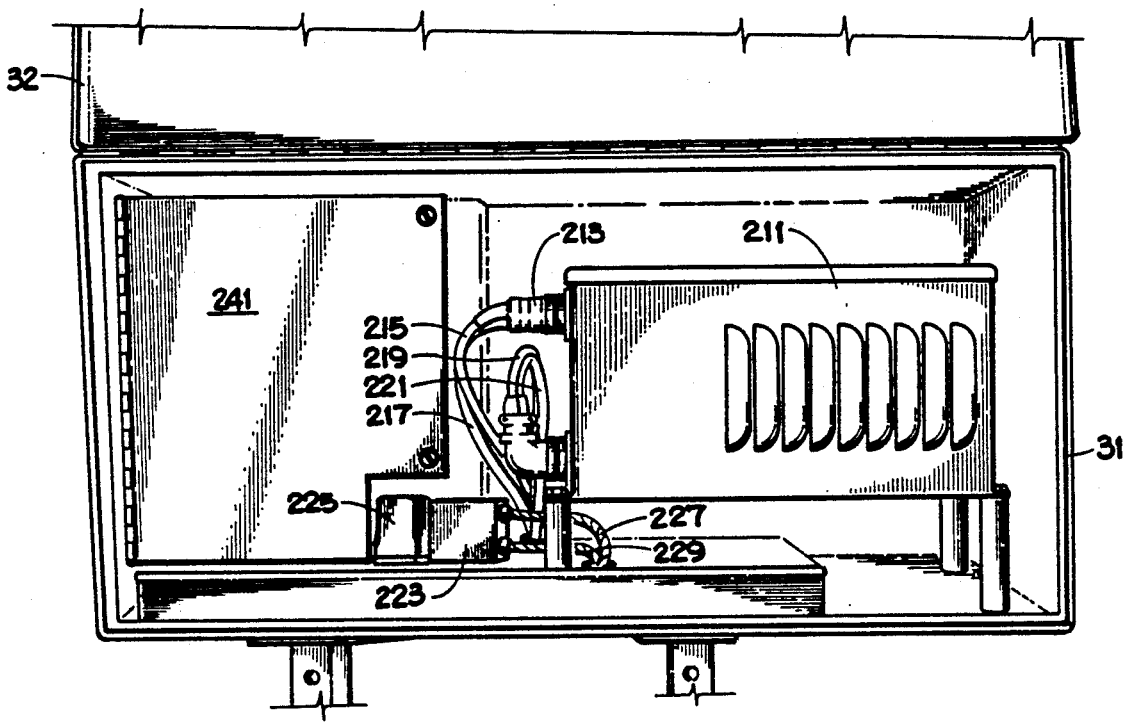
FIG. 5 is a fragmentary rear elevational view of the control box of the apparatus of FIG. 1.

As seen in FIG. 5 the rear of control unit 31 is provided with a door 32 (shown in the open position). Door 32 is provided for service and maintenance and is not intended for operator access. Within control unit 31 is an electronic motor control unit 211 of generally conventional form for controlling the operation of film feed motor 141. Motor control unit 211 functions in a conventional manner to respond to input signals to stop or start motor 141, to run motor 141 at a controlled speed, or to count the revolutions of motor 141 to stop the motor at a predetermined adjustable revolution count. Depending on the nature of the motor and the motor control the motor may be controlled as to fractions of a revolution rather than a full revolution, and it will be understood that reference to a revolution or cycle of the motor may also apply to a predetermined fraction of a revolution.

Motor control unit 211 is provided with a conventional connector 213 for the connection of electrical signal cables 215 and 217 and is also provided with power cables 219 and 221 for input power to the motor control unit 211 and for supplying power to the motor 141.

Also in control unit 31 is an optical-electronic transducer unit 223 and a power transformer 225 for the transducer unit 223. Fiberoptic cables 227 and 229 are connected to the transducer unit 223 for transmitting and receiving optical signals for index mark sensor 163. A tray detector 195 (shown in FIG. 2) is coupled to transmit signals to motor control unit 211 by a cable 197. Fiberoptic cables 165 and 166 for index mark sensor 163 are coupled in a suitable manner to fiberoptic cables 227 and 229 of transducer unit 223. The electronic signals generated by optical-electronic transducer unit 223 are transmitted by an electric cable connection (not shown) to motor control unit 211. Closure 241 inside control unit 31 may be opened for access to the back of controls and indicators mounted on the front of control unit 31 behind door 33.

Figure 6:
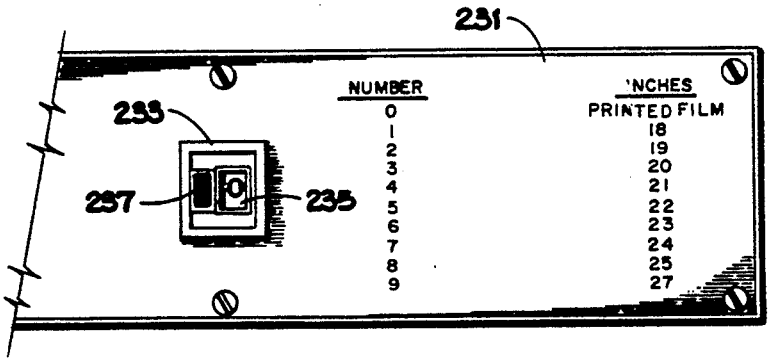
FIG. 6 is a front elevational fragmentary detail view showing an operator accessible control for setting film feed travel.

Referring to FIG. 6, thumbwheel switch 233 is shown in detail as mounted on control panel 231 which is behind the transparent door 33 of control unit 31. As illustrated there are ten settings for film wheel switch 233 which may be selected by movement of thumbwheel 237, and the current setting is indicated by mechanical indicator 235. Thumbwheel switch 233 is electrically connected to motor control unit 211 by electrical conductors which are not shown. It will be understood that thumbwheel switch 233 may be replaced by any of numerous types of selector switches of electronic or electromechanical nature controlled by keys, buttons or the like, and the indicator may be an LED, LCD or other electronic display. In FIG. 6 thumbwheel selector switch 233 is set to zero for printed film using index marks to control the film sheet feed. Switch 233 alternatively may be set to numbers 1 to 8 for film feeds of 18 to 25 inches respectively or to 9 for film feed of 27 inches.

Although the operation of the apparatus according to the invention has been described generally above, the operation will better be understood from the following detailed description. A wrapping film roll 13 is placed in the machine on rollers 15 and 18 and the film is fed through the rollers in the path shown in FIG. 2 by releasing roller 18 with handle 29 and releasing roller 73 with handle 25. Once the end of the film is fed between rollers 83 and 85 and between belts 87 and 89, rollers 18 and 73 may be placed in operating position, and the machine may be cycled to fully transport film sheet 3 into the machine.

In the automatic mode of operation, film sheet 3 is automatically fed by a distance equal to the distance between consecutive index marks 7. As the main shaft 131 of the wrapping machine rotates, the micro-switch 137 sends a timing signal to motor control unit 211, and if at the same time the tray detector 195 optically senses the presence of a tray 193, motor control unit 211 starts motor 141 and it continues to run at a controlled speed to advance film sheet 3 at about four feet per second until an index mark 7 is detected by the index mark sensor 163. Index mark sensor 163 as illustrated produces a light beam which passes down through transparent film sheet 3 in the absence of an index mark 7 so that interruption of the light beam signals the presence of an index mark 7. Alternatively the index mark sensor 163 could be replaced by a sensor which operated by reflected light and tray detector 195 is illustrated as such a reflected light sensor. Upon receiving a signal from index mark sensor 163 indicating the presence of an index mark 7, motor control unit 211 stops motor 141, preferably after a pre-programmed distance of travel of film sheet 3. This distance may be 7½ inches, for example The time for film travel represents a small portion of the machine cycle following which perforating knife 103 operates to produce perforations 9 across film sheet 3 somewhat in advance of index mark sensor 163. Also following the transport of film sheet 3 by the operation of film feed motor 141, the wrapping operation takes place. A tray 193 resting on an elevator platform indicated schematically at 191 is located below a frame 185 of the wrapping station the end of film sheet 3 lies just below the frame 185 and extends across the opening in frame 185. Clamp pads 189 (and other clamp pads not shown) are operated by the motion of rods 187 to press the periphery of a section of film sheet 3 against frame 185 while at the same time the elevator platform raises tray 193 up against the film sheet and through the opening in frame 185. Folding arms 182 and 183 then operate to tuck the film sheet edges under the tray 193 at the same time overcoming the clamping action of clamp pads 189. In the same motion, folding arm 182 is separating film sheet 3 along a perforating line 9 immediately to the right of folding arm 182. If desired, a film sheet clamp may be provided between folding arm 182 and roller 71 to hold the next sheet while the last sheet is torn away at the perforation. The wrapping operation is completed by other folding elements and transport elements as described in the above mentioned application.

It will be noted that the presence of the index marks 7 on the film sheet 3 and the operation of the apparatus previously described assures that the proper length of film will be fed at each operation of the machine. However, it is important to properly center the printed pattern on the tray and different size film sheets (measured between the index marks) could cause misplacement of the film sheet relative to the wrapping station and particularly misplacement of the printed pattern on the wrapped tray. Proper registration of the film sheet and the pattern thereon with respect to the tray being wrapped is achieved by gradual adjustment of the position of roller 51 during sheet feed as previously described.

The film feed apparatus described is also capable of operation with unprinted film wherein a pre-determined length of film is fed on each cycle by reason of a preset rotational motion of the film feed motor. The amount of movement of the film feed motor is set by means of thumbwheel switch 233 as previously described. The adjustment of roller 51 position and resulting film path length may also be employed with unprinted film to assure that the film sheet is approximately centered on the tray.

In addition to the variations and modifications to the apparatus which have been described or suggested above other variations and modifications will be apparent to those skilled in the art, and accordingly the scope of the invention is not to be considered limited to the particular embodiment and the variations and modifications shown, described or suggested but is rather to be determined by reference to the appended claims.

What is claimed is:

1. In a tray package wrapper machine having means for supporting a roll of wrapping film, a wrapping station with motor driven elevator platform and folding arms for tucking film sheet edges under a tray on said platform, means for advancing trays to said wrapping station, and means for transporting trays away from said wrapping station, an improved film sheet feeding and perforating apparatus comprising (a) a film feed motor separate from the motor for said elevator platform and folding arms, p1 (b) a film feed mechanism for advancing film drawn from said roll of wrapping film and connected to said film feed motor to move in direct relation to the movement of said motor, (c) a plurality of rollers defining a path for film from said roll of wrapping film to said wrapping station, one roller of said plurality of rollers being mounted on a movable support and being provided with position adjusting means to allow lengthening and shortening of said path and two others of said rollers being driven rollers, (d) a perforating knife for producing a line of perforations across said film, said knife being positioned upstream of said one roller and one of said driven rollers, but downstream from another of said driven rollers, and being operated in synchronism with said elevator platform and folding arms, (e) a tray sensor for sensing presence of a tray to be wrapped, (f) a mark sensor positioned upstream of said one roller for sensing an index mark on said sheet of film, and (g) automatic motor control means for causing said film feed motor to rotate upon receiving signals from said tray sensor, and to stop rotating upon receiving a signal from said mark sensor in response to an index mark arriving at the mark sensor position.

2. Apparatus as recited in claim further including means associated with said automatic motor control means for causing said film feed motor to stop after a predetermined number of cycles in the absence of a signal from said mark sensor.

3. Apparatus as recited in claim 2 further including an operator accessible control for setting said predetermined number of cycles of said film feed motor, said control being calibrated in distance of film travel corresponding to the predetermined number of cycles.

4. Apparatus as recited in claim 1 further including film handling means adjacent said wrapping station for restraining said film upstream of a line of perforations made on a previous machine feed and perforate sequence whereby the film tucking action of the adjacent one of said folding arms acts to tear said film at said line of perforations.

5. In a tray package wrapping machine having means for supporting a roll of wrapping film, a wrapping station with motor driven elevator platform and folding arms for tucking film sheet edges under a tray on said platform, means for advancing trays to said wrapping station, and means for transporting trays away from said wrapping station, an improved film sheet feeding nd perforating apparatus comprising (a) a film feed motor separate from the motor for said elevator platform and folding arms, (b) a film feed mechanism for advancing film drawn from said roll of wrapping film and connected to move in relation to the movement of said motor, (c) a plurality of driven rollers defining a path for film from said roll of wrapping film to said wrapping station, (d) a perforating knife for producing a line of perforations across said film, said knife being positioned upstream of one of said rollers and downstream from another of said rollers.

(e) a tray sensor for sensing presence of a tray to be wrapped, (f) a mark sensor positioned along the path defined by said plurality of rollers for sensing an index mark on said sheet of film, (g) automatic control means for causing said film feed mechanism to operate upon receiving signals from said tray sensor, and to stop operation upon receiving a signal from said mark sensor in response to an index mark arriving at the mark sensor position, and (h) means associated with said automatic control means for causing said film feed mechanism to stop after a predetermined distance of film travel in the absence of a signal from said mark sensor.

6. Apparatus as recited in claim 5 further including an operator accessible control for setting elapsed time of operation of said film feed mechanism, said control being calibrated in distance of film travel corresponding to said elapsed time of operation.

7. Apparatus as recited in claim 5 further including a shaft rotation sensor for sensing a predetermined portion of the operating cycle of said elevator platform and folding arms and wherein a signal from said shaft rotation sensor as well as said tray sensor is required to operate said film feed mechanism.

8. In a tray package wrapping machine having means for supporting a roll of wrapping film, a wrapping station with motor driven elevator platform and folding arms for tucking film sheet edges under a tray on said platform, means for advancing trays to said wrapping station, and means for transporting trays away from said wrapping station, an improved film sheet feeding and perforating apparatus comprising (a) a film feed motor separate from the motor for said elevator platform and folding arms, (b) a film feed mechanism for advancing film drawn from said roll of wrapping film and connected to move in direct relation to the movement of said motor, (c) a plurality of driven rollers and undriven rollers defining a path for film from said roll of wrapping film to said wrapping station, (d) a perforating knife for producing a line of perforations across said film, said knife being positioned at least about 18 inches upstream from the nearest of said folding arms and downstream of one of said driven rollers, (e) a tray sensor for sensing presence of a tray to be wrapped, (f) a mark sensor positioned upstream of said one of said rollers for sensing an index mark on said sheet of film, and (g) automatic control means for causing said film feed mechanism to operate upon receiving signals from said tray sensor, and to stop operation upon receiving a signal from said mark sensor in response to an index mark arriving at the mark sensor position.

9. Apparatus as recited in claim 8 further including means associated with said automatic control means for causing said film feed mechanism to stop after a predetermined distance of film travel in the absence of a signal from said mark sensor.

10. Apparatus as recited in claim 9 further including an operator accessible control for setting elapsed time of operation of said film feed mechanism, said control being calibrated in distance of film travel corresponding to said elapsed time of operation.

11. Apparatus as recited in claim 10 further including film handling means adjacent said wrapping station restraining said film upstream of a line of perforations and positioned to cause the film tucking action of the adjacent one of said folding arms to tear said film at said line of perforations.

12. Apparatus as recited in claim 8 further including a shaft rotation sensor for sensing a predetermined portion of the operating cycle of said elevator platform and folding arms and wherein a signal from said shaft rotation sensor as well as said first sensor is required to operate said film feed mechanism.

* * * * *